US006904730B2

(12) United States Patent
Mitchell

(10) Patent No.: US 6,904,730 B2
(45) Date of Patent: Jun. 14, 2005

(54) ROOF PANEL CLIP

(76) Inventor: James Mitchell, 2283 NE. Marguerite St., Jensen Beach, FL (US) 34857

( * ) Notice: Subject to any disclaimer, the term of this patent is extended or adjusted under 35 U.S.C. 154(b) by 0 days.

(21) Appl. No.: 10/347,558

(22) Filed: Jan. 21, 2003

(65) Prior Publication Data

US 2003/0145548 A1 Aug. 7, 2003

Related U.S. Application Data

(60) Provisional application No. 60/349,619, filed on Jan. 22, 2002.

(51) Int. Cl.[7] ..... E04D 1/00

(52) U.S. Cl. ..... 52/536; 52/520; 52/547; 52/551; 52/713; 52/478; 52/545

(58) Field of Search ..... 52/520, 536, 547, 52/551, 713, 478, 545

(56) References Cited

U.S. PATENT DOCUMENTS 3,903,670 A * 9/1975 Robinson, Jr. ..... 52/478
4,514,952 A * 5/1985 Johansson ..... 52/713
4,796,403 A * 1/1989 Fulton et al. ..... 52/713
5,321,927 A * 6/1994 Bellem ..... 52/545
5,341,617 A * 8/1994 Thomas et al. ..... 52/547
5,606,838 A * 3/1997 Hughes et al. ..... 52/713

FOREIGN PATENT DOCUMENTS

DE 3609883 * 9/1987

* cited by examiner

*Primary Examiner*—Laurie K. Cranmer
(74) *Attorney, Agent, or Firm*—Kevin Redmond

(57) ABSTRACT

A roof panel clip that extends ten feet in length rather than the usual prior art one to two inches, enabling the clip to span the distance between two purlins to support roof panels over these distances. The extended length of the clip enables it to provide greater strength against uplift loads than that which was possible with the older narrower clips and this continuous clip can be installed more quickly than a series of the ususal smaller clips used to cover the same span.

2 Claims, 7 Drawing Sheets

ROOF PANEL CLIP

This application claims the benefit of 60/349,619 filed Jan. 22, 2002.

BACKGROUND

1. Field

The present invention relates to roofing clips and more particularly to such clips that are applied to secure metal roofing panels.

2. Prior Art

Typically, metal roofing panels are secured to roof using relatively small clips that are one to three inches long. Each clip is secured to the roof by means of several screws. The clips are positioned at regular intervals along a roofing panel at a spacing of 16 to 24 inches on center.

A typical clip 14 is shown in FIGS. 8A and 8B and the use and method of installation is described in U.S. Pat. No. 4,796,403. These clips that have a width of typically only 3 inches have worked reasonably well for years, but there are some problems that these clips present that have not previously been solved.

Among the problems are the following:

1. High spot up-lift loads can tear out a single clip. With the roofing panel being made less secure with one clip gone, the next clip is more easily torn out because it receives a greater load. The loss of clips continues until there is no support for the panel and it is blown away.

2. Roofing installers are often left to determine spacing between clips or even if a clip will be used in some locations. There is little in the prior art to force the installer to place clips at a preferred center to center spacing distance.

3. It is time consuming to install 15 individual clips along a 20 foot roofing panel. By installing all the clips, the roof's integrity is maintained, however, the cost is high because of the level of labor required to install the clips. If the spacing is decreased the cost goes down, but the integrity of the roof is compromised. These and other problems associated with prior art metal roof clips are addressed and solved by the present invention described in the following sections.

SUMMARY

It is an object of the present invention to provide a roofing clip that can be installed quickly.

It is an object of the present invention to provide a roofing clip that provides an increased up-lift load capability.

It is an object of the present invention to provide a roofing clip that provides strength to the roofing panels between purlins.

A continuous panel clip that extends typically ten feet in length rather than the usual prior art one to two inches, enabling the clip to span the distance between purlins and support roof panels over these distances. Shorter or longer lengths such as 12 inches to 20 feet or any length are possible for the continuous clip. The extended length of the continuous clip enables it to provide greater strength against uplift loads than that which was possible with the older short clips and this continuous clip can be installed more quickly than a series of the usual short clips commonly use to cover the same span.

The present invention includes a long "L" shaped bracket with attached individual, small clips spaced apart along the bracket at a uniform distance of typically 16 inches. The "L" bracket has two sections with one held parallel to the roof while the second section stands orthogonal to the first. The small clips are connected to the second section through slots placed in the second section. The slots allow for expansions and contraction of the roof under various environmental conditions as well under other loads placed on the roof. Attaching the long "L" shaped bracket securely holds all of the clips in place and insures that sufficient clips are present to properly secure the roof panels against up-lift loads.

DETAILED DESCRIPTION OF THE INVENTION

Figure 1:
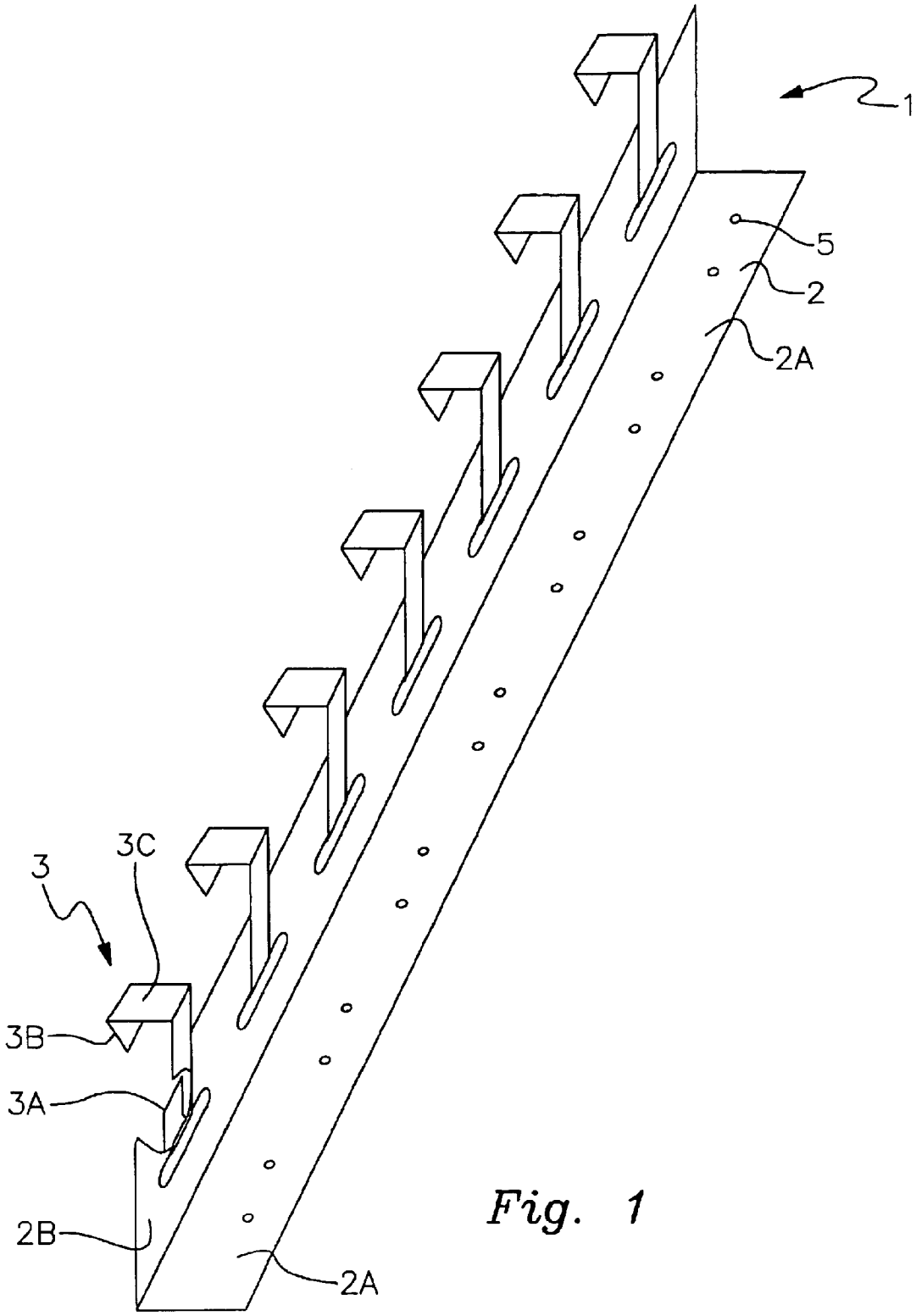
FIG. 1 is a perspective view of the continuous clip of the present invention using a first variation of an individual clip.

FIG. 1 is a perspective view of a first form of a continuous clip 1. This version of the continuous clip consists primarily of a long "L" bracket 2 which includes two sections, a mounting plate 2A and a clip support plate 2B, that is positioned orthogonally with respect to the mounting plate. The clip support plate includes a series of slots, such a slot 4 through which are installed a series of individual clips such as clip 3.

The first individual clip 3 located to the left in this figure and the clip support plate 2B are cut away to illustrate how an individual clip is bent up to provide a portion 3A of the individual clip that hold this clip in the slot 4. At the opposite end of the clip is a portion 3B that is positioned vertically. Connected to and located above the portion 3B is a portion 3C which is positioned horizontally. The portions 3B and 3C are used to connect the clip to the seams of the roofing panels as will be shown and described in connection with FIGS. 6A through 6C.

Figure 8A:
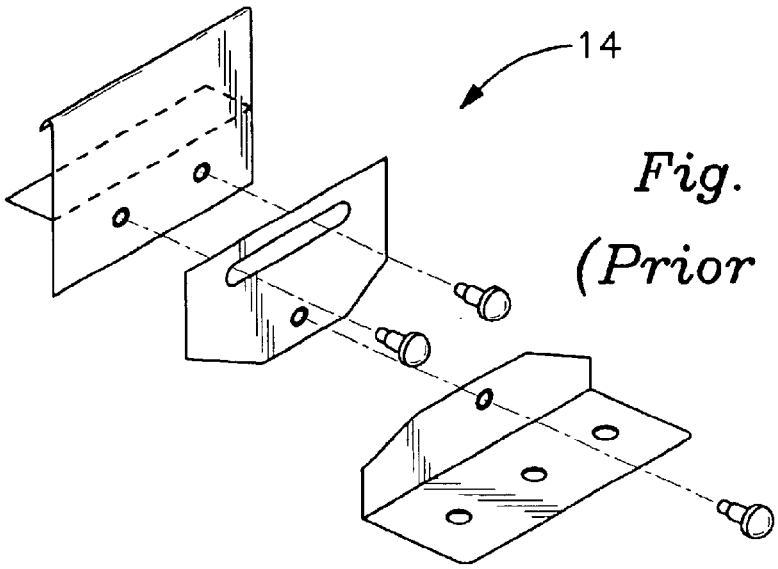
Fig. 8A (Prior Art)
FIG. 8A is a perspective view of a prior art individual clip.
Figure 8B:
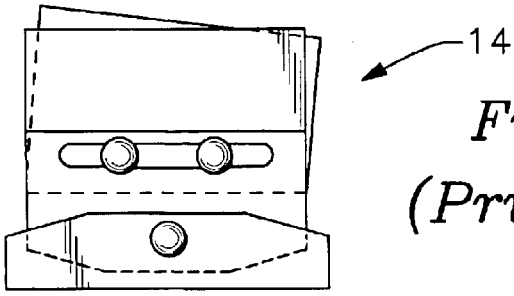
Fig. 8B (Prior Art)
FIG. 8B is a front elevation view of the clip of FIG. 8A.

The mounting plate 2A includes a series of holes, such as hole 5, distributed along the length of the mounting plate to permit mounting the "L" bracket to a substrate, such as a roof, by means of screws that are passed through these holes and screwed into the roof. The continuous clip is so named because it is typically ten feet long, whereas commonly used short, independent clips, such as the one shown in FIGS. 8A and 8B are only 2 to 3 inches long. The many individual clips used in the present invention with one "L" bracket are spaces 16 to 24 inches apart along the clip support plate, which is the same spacing commonly used to mount short independent clips along a roofing panel.

The individual clips of the present invention are used in newer installation systems to hold down roof panels in metal roofing systems. These clips avoid puncturing the roof which was required for mounting screws in older installation methods. The clips grip the edge of the panel and are themselves covered by the edge of the next adjacent panel. The method of connection to the panel is shown in FIGS. 3, 4, 6 and 7 and is described below.

The advantages of the continuous clip over a plurality of commonly used short clips are many and some are unexpectedly beneficial. First and foremost is the added strength provided by the continuous clip to up-lift loads. Where a small clip is used, it can be pulled out by a high spot level of up lift force, such as that produced by the high winds of a hurricane. Once one clip has been pulled out, the next clip in line holding a roofing panel received an even greater up-lift force because it is required to withstand the up-lift force for its own position on the roof panel as well as part of the up-lift force that was previously provided by the clip that has been pulled out. In addition, the panels tend to be picked up by the wind and act as a sail, greatly increasing the up-lift force where a clip has been lost. The result is a tearing out of one clip after another along a panel once one clip has been lost. Test results described below show the continuous clip to have unexpectedly good results in withstanding uplift loads, a very important factor in resisting hurricane force winds.

With the present invention, no individual clip is left only to its own mounting screws to survive. The entire "L" bracket is held down to the roof by a series of screws along the "L" bracket. No one clip can be pulled up. The entire "L" bracket with all its mounting screws would have to be moved at once in an upward direction against the holding force of all the screws. The result is a substantially greater resistance to up-lift forces is provided by the present invention. The clips are held securely by the continuous clip of the present and its many mounting screws.

Where the continuous clip is used with purlins, and the mounting screws or other mounting attachment means make a rigid connection between the bracket and the purlins, the bracket of the continuous clip prevents racking of the purlins because it forms a rigid box structure. This feature strengthens the roof and the building against uplift and other loads.

The bracket may be rigidly attached to the purlins by using two or more screws, welding, riveting, square pins or other rigid attachment means at each junction of the bracket and the purlins. This rigid attachment prevents rotation of the brackets with respect to the purlins and this prevents purlin roll.

When the purlins roll, they can be turned sideways where they may have no strength, allowing them to be bent up due to uplift wind loads. When this occurs, the roof may be blown away or fall inward. The rigid connection of the bracket of the present invention to the purlins totally prevents this type of failure.

The holes in the bracket used to accept the individual clips may be placed in the bracket so that individual clips will be located between purlins where the clips could not be placed when using short clips.

As few or many holes and clips may be used as necessary between purlins to sustain required up lift and other live loads.

A second advantage of the continuous clip is the speed with which it may be installed. Once a screw has been installed at both ends of the mounting plate, it holds itself in position while the remainder of the screws are installed. With the small prior art clips each and every clip has to be located and then held in position while two to three screws are installed.

Where the substrate is formed of spaced apart purlins, the continuous clip provides strength for the roofing panels between purlins. The continuous clips angle bracket provides strength against bending between the purlins and the individual clips hold down the roofing panels between the purlins where conventional small clips cannot be placed. The presence of the continuous clip bracket between purlins provides strength to the panels against both uplift and live loads that other clip systems cannot provide.

In addition, the continuous clip has greater strength than the conventional clips because heavier gauge steel is used for the continuous clip. The continuous clip typically uses 18 gauge steel as opposed to the 22 gauge typically used on conventional small clips. The gauge of the continuous clip can be varied as needed to suit a particular application.

The present invention was tested at the Hurricane Test Laboratory, Inc. on 09-22-02 with outstanding results. The following is an excerpt from the results of that test using the continuous clip of the present invention.

For this test, a load was applied in the form of suction on the upper surface of the roof panels. The load was applied in 20 psf increments until 135 psf was achieved, at which point no additional load could be applied to the sample. The flat of the roof panels had deflected and distorted to such a degree that it had bottomed-out on the framing of the test chamber. NOTE: The flat of the panels deflected approximately 15" from its original shape without disengaging. The sample was thoroughly inspected. No failures were observed in the clip attachments of the continuous clip (of the present invention) to the purlin or to the attachment between the panels and the continuous clip at the standing seams of the panels.

Figure 2:
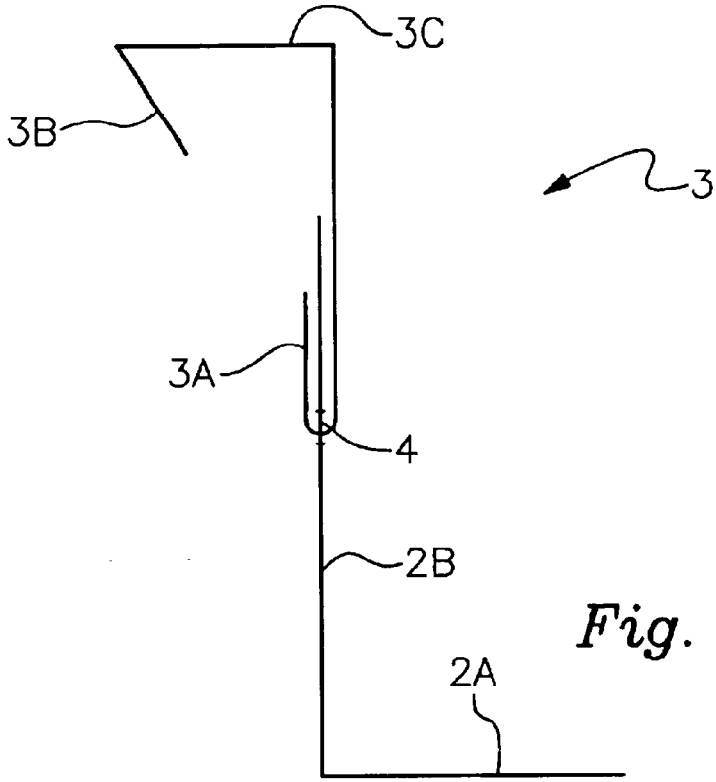
FIG. 2 is a front elevation view of the L bracket and an individual clip of the type shown in FIG. 1.
Figure 2A:
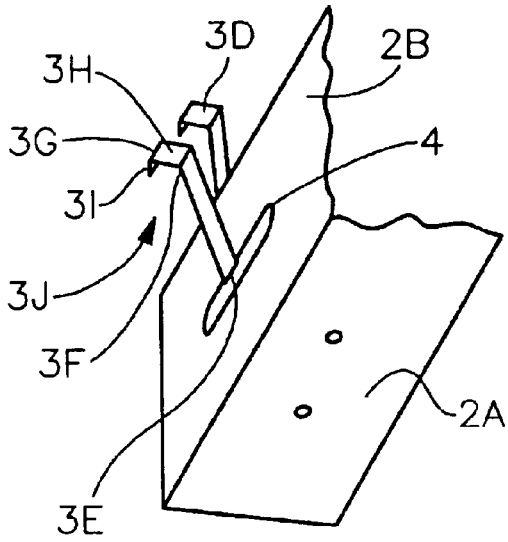
FIG. 2A is a perspective view of second version of the individual clip used with the present invention.
Figure 2B:
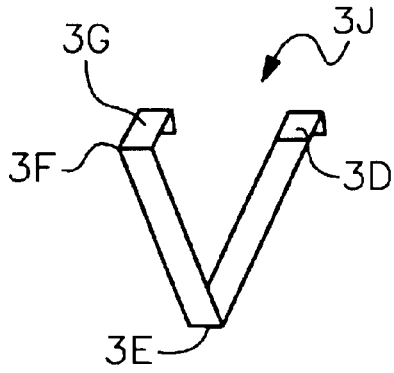
FIG. 2B is a front elevation of the individual clip of the type shown in FIG. 2A.
Figure 2C:
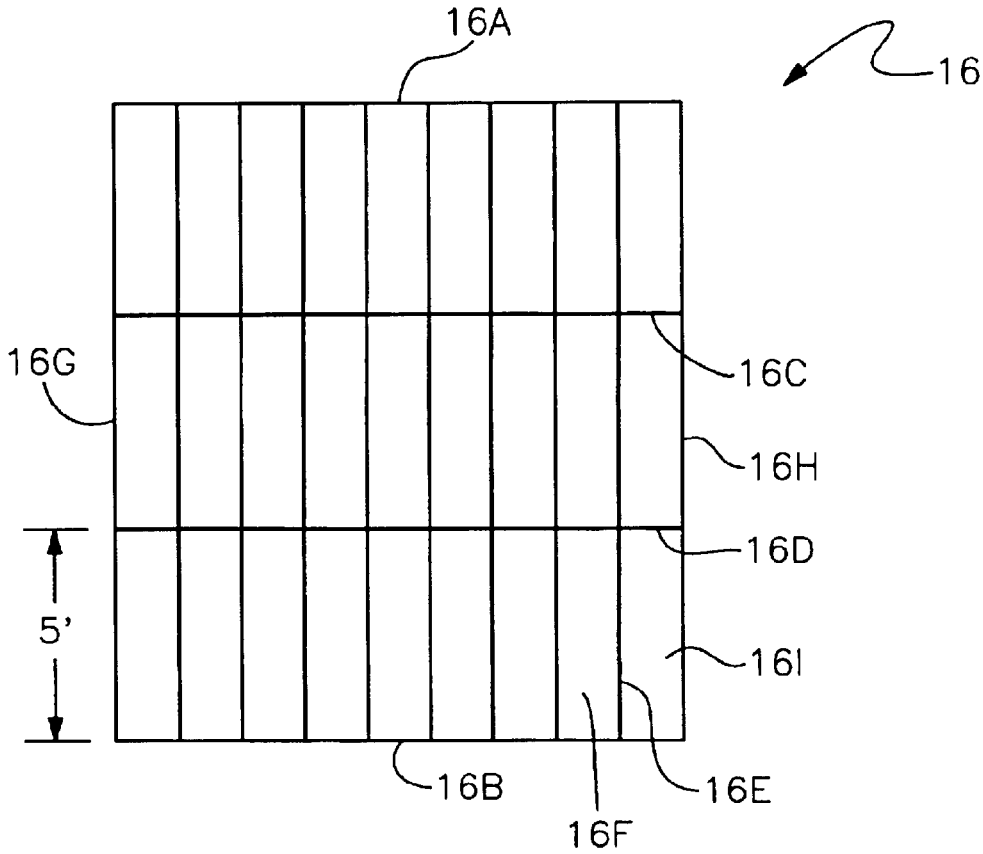
FIG. 2C is a plan view of a roof showing the location of the purlins, continuous clip and roof panels.

FIG. 2C is a plan view of a roof 16 having a ridge end 16A, and eave end 16B, a first gable end 16C and a second gable end 16H. A first purlin 16C located 5 feet below the roof ridge extends horizontally from the first gable and to the second gable and, while a second purlin 16D, located 5 feet below the first purlin extends from the first gable and to the second gable end. Adjacent roof panels 16F and 16I extend vertically in this figure across and are supported by the purlins from the eave to the ridge. A seam 16E extends vertically between and at the junction of panels 16F and 16I. Beneath this seam resting on and attached to the purlins is a continuous clip containing a plurality of individual clips, which are combined into the seam to hold the panels on the roof. The panels are supported to withstand uplift and down loads between the purlins by the continuous clip which spans the distance between the purlins.

FIG. 2 is a front elevation view of the "L" bracket 2 and an individual clip 3 of the type shown in FIG. 1. The clip 3 is in the form of the numeral 7, with the end of the upper portion 3B being bent downward and the end of the lower portion 3A being bent upward. As will be shown in FIGS. 6A through 6B, the upper end 3B is used to connect the clip to the roofing panels, while the lower end 3A can be seen in FIG. 2 to be used to hold the individual clip 3 to the clip support plate 2B. The lower end 3A of the clip 3 is held to the support plate by first passing it through a slot 4 in the clip support plate and then it is bent upward against the clip support plate. The slot allows the clip some lateral movement along the longitudinal axis of the support plate as well as some movement orthogonal to this axis to accommodate various loads on the roof as well as the expansion and contraction caused by temperature variations.

FIGS. 2A and 2B shows a second type of individual clip 3C installed through the hole 4 in the L bracket 2. This individual clip 3J is essentially a strip of metal with five bends in it. The first bend is in the middle at point 3E which divides the strip into a first and a second half. The end of the first half is bent orthogonal to the strip at point 3F and then again near the tip at point 3G forming a first flat area 3H which is similar to surface 3C in FIG. 2 and a second flat area 3I at the tip of the strip which is similar to the surface 3B in FIG. 2. The end of the second half of the strip is bent in a manner identical to the first half. The two ends of this strip are combined into the roof seam as will be shown in connection with FIGS. 6A through 6C, locking both ends of the strip into the seam for excellent holding power against up lift levels.

Figure 3:
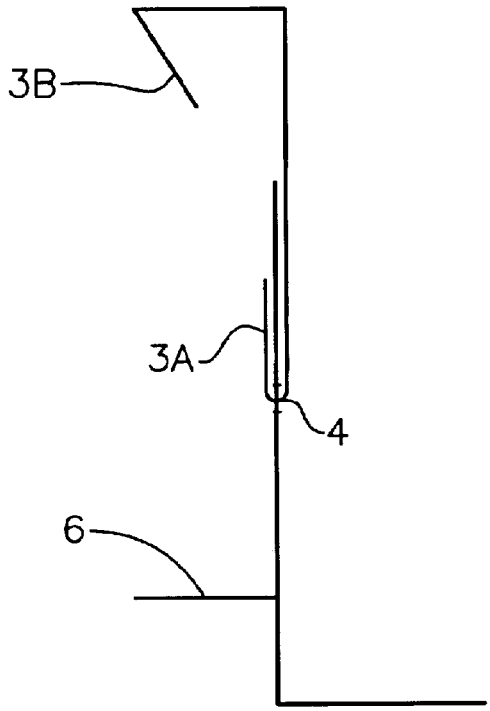
FIG. 3 is a front elevation view of a continuous clip used with a purlin.

FIG. 3 is similar to FIG. 2 with the exception of the ledge 6 which is used for two purposes. The first is to provide a support for a roof panel and the second is as a stiffener to provide added support between purlins. The continuous clip of FIGS. 1 and 2 can be used with either a roof or with purlins. The only difference is that with purlins, the "L" bracket is connected to and supported only at the points where it crosses the purlins. Typically, the continuous clip is ten feet long and purlins are spaced five feet on centers. The continuous clip spans three purlins and is connected to all three.

Figure 4:
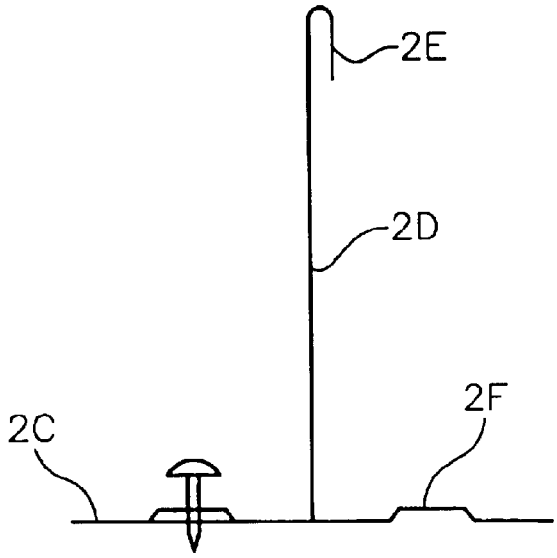
FIG. 4 is a second version of a continuous clip made in accordance with the present invention.
Figure 7:
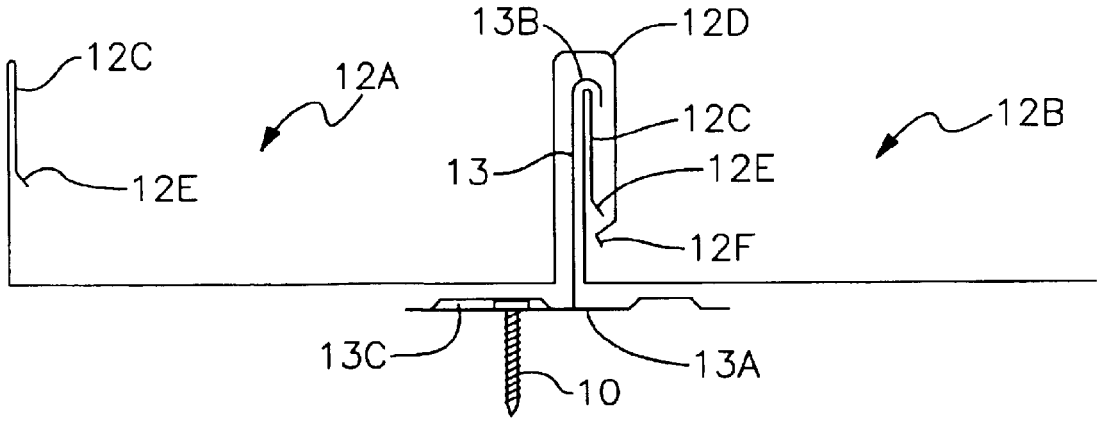
FIG. 7 is a front elevation view of two panels and a clip which snaps together to make a seal.

FIG. 4 is a front elevation view of a second variation of the continuous clip. In this case, rather than an angle bracket, the continuous clip is in the form of a inverted letter "T" with the horizontal portion of the "T" serving as the mounting plate 2C and the vertical portion of the "T" serving as the clip supports plate 2D. Raised portions of the mounting plate 2F are used to support the panel above the head of the mounting screws. There is a downwardly bent upper end of the "T" clip support plate 2E. The bent down end 2E serves the same function as the end 3B in FIG. 2 which is to grip the edge of the panel as shown in FIG. 7. The panels are not bent. They are merely snapped in place. The panel is held on the top and bottom of the continuous clip all along the continuous clip, even in the spaces between the purlins.

Figure 5:
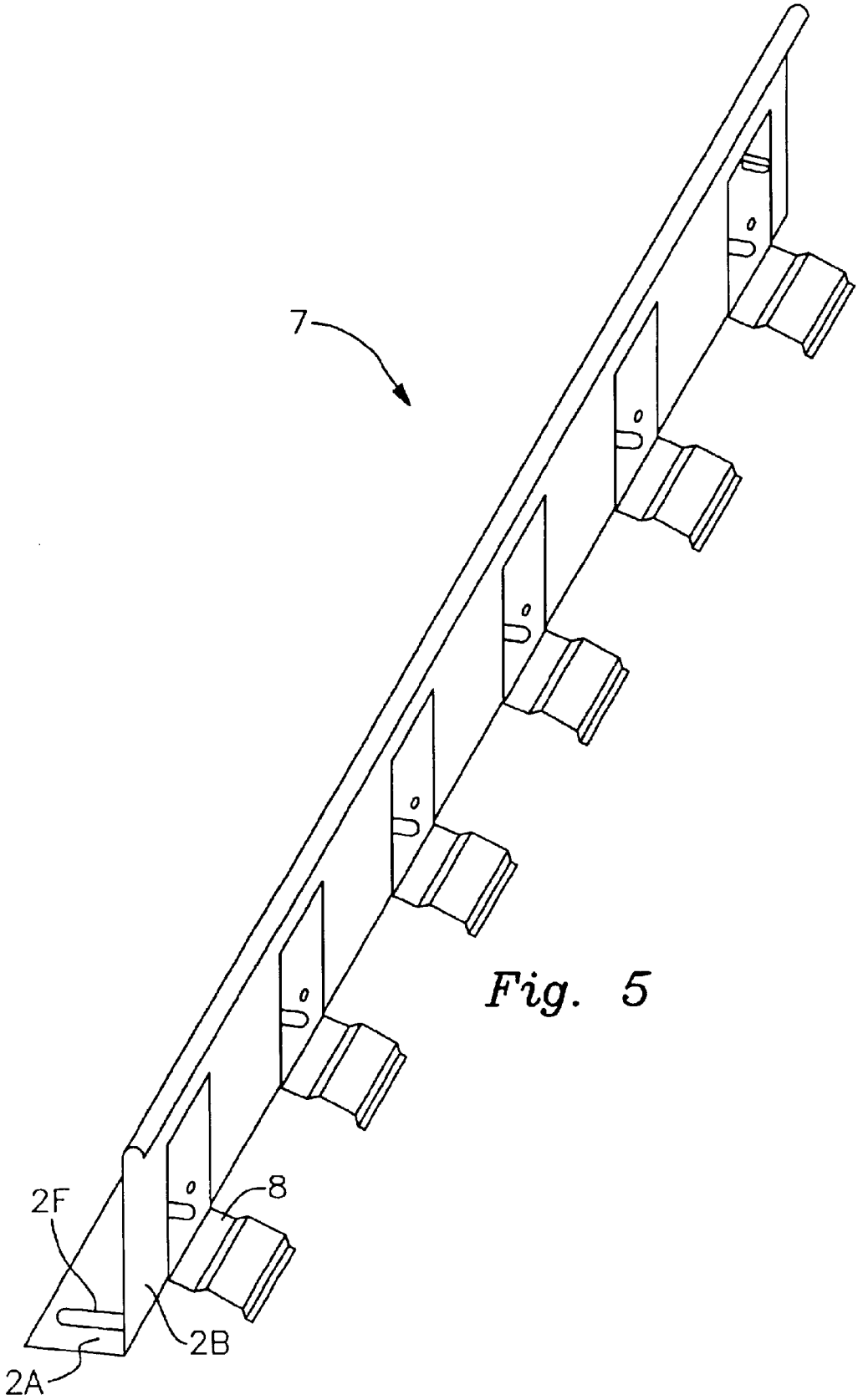
FIG. 5 is a perspective view of the second version of the present invention as used with the individual clips used with snap lock panels.

FIG. 5 shows a perspective view of the second variation of the continuous clip and is the continuous clip that is used in FIG. 7.

Figure 6A:
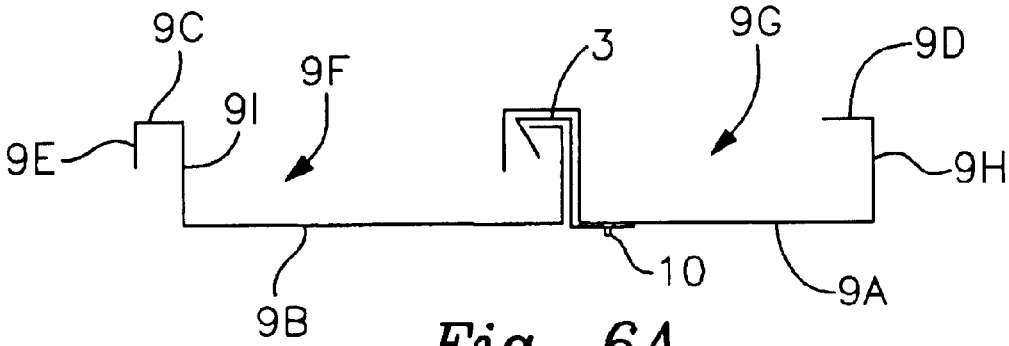
FIG. 6A is a front elevation view of a clip and two panels which shows the position of two panels and the clip before they are bent to provide a sealed joint.
Figure 6B:
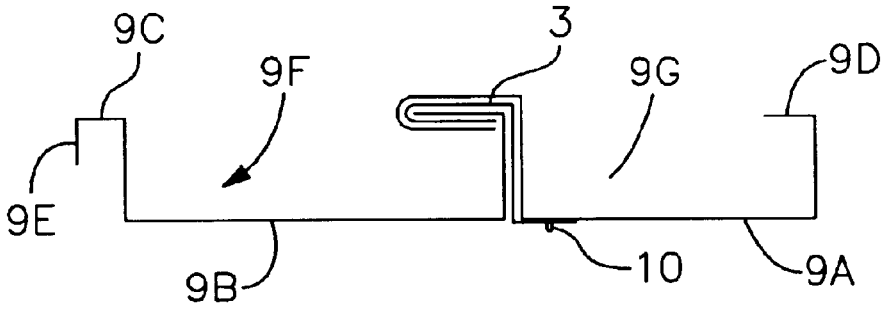
FIG. 6B shows the elements of FIG. 6A partially bent to 90° as a first step in producing a seal.
Figure 6C:
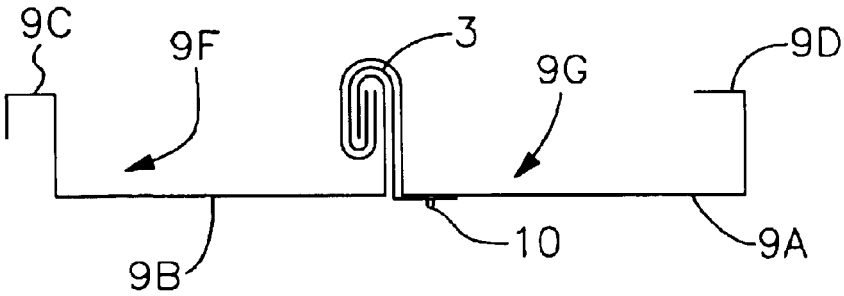
FIG. 6C shown the elements of FIG. 6B further bent to 180° to complete the seal.

FIGS. 6A through 6C show the method of attaching two adjacent panels to a continuous clip of the type shown in FIGS. 1 and 2. The left hand panel in these Figures is designated 9F while the right hand panel is designated 9G. These panels are identical, however, their own individual right and left ends are different. The right end is shown clearly at the right end of panel 9G. It is shaped like the numeral "7" with a vertical portion 9H and a horizontal portion 9D which is connected at one end to the top of the vertical portion 9H.

The form of the left end of these panels is shown clearly on the left end of panel 9F. This left end is also configured like the numeral "7" having vertical portion 91 and a horizontal portion 9C, but it also has an tip 9E formed from the horizontal portion 9C that is bend downward. In the middle of this Figure, at the junction of the two panels is a clip 3. Beneath the clip 3 is the right end of the left panel, while over the clip is the left end of the right panel.

FIG. 6B is identical to FIG. 6A with the exception that where the panels overlap each other in the middle of this drawing, the panel ends and the clip end have been crimped together to form a shape like the numeral "7". This is referred to as the 90° position.

FIG. 6C is identical to FIG. 6B with the exception that the panel end and clip have been bent another 90° to make a total 180° bend which results in sealing the panels together and connecting the panels to the clip which secures the panels to the roof.

FIG. 7 shows two roof panels 12A and 12B which are placed adjacent to one another and are connected to a clip 13 without the need for crimping. These panels and the clip simply snap together. The left hand end of the panel 12A is in the form of an inverted "U" with a lip 12E extending outwardly from the lower end of the inverted "U".

Panel 12B has an identical shape with the inverted "U" shape portion being located at the left end of this panel. This left end of 12B is placed beneath the clip 13. The clip 13B is similar to the clip shown in FIG. 4 with an inverted "U" shaped top 13B. This clip is secured to the roof with screw 10 which goes through a mounting plate 13C located at the base of the clip.

Above the clip 13 is the right hand end 12D of the panel 12A. This end is also in the form of an inverted "U" but it is large enough to cover the clip 13. It has a "V" shaped end 12F which lies immediately below the lip 12E of the right hand panel and secures the lip 12E in place.

In the assembly of these two panels and the clip, the left end 12C of the right panel 12B is inserted below and is held in place by the inverted "U" shaped top of clip 13. The lip 12E on the bottom of the right end 12D of the left panel 12A is placed over the clip 13 and pressed down along side the lip 12E displacing the lip to the left. After the "V" shaped end 12F passes the lip 12E, the lip snaps back from its displacement and is prevented from moving downward by the "V" shaped end 12F. The left end 12C is also prevented from moving upward or to the left or right by the clip 13.

As can be seen from the various configurations presented, the continuous clip can be adapted to many variations in individual clip design as well as methods of sealing and securing the roof panels, however, all of these variations gain the benefits of improved strength, as well as improved ease and speed of installation provided by the use of the continuous clip.

Having described my invention, I claim:

1. A continuous clip for securing roofing panels to a substrate comprising:

(a) a bracket having a longitudinal axis, said bracket extending greater than 11 inches along said axis, and said bracket having a first set of spaced apart holes being generally distributed along the bracket in the direction of said longitudinal axis, (b) clip means formed by a plurality of individual clips for attaching said bracket to said substrate in which each individual clip is formed of a strip of flexible material and each individual clip is passed through one of said first set of holes to attach each of said individual clips to said bracket, and each of said individual clips is also attached to said roofing panels to attach said roofing panels to said bracket by way of said individual clips, and (c) a second set of spaced apart holes, said second set of spaced apart holes being distributed along said bracket in the direction of said longitudinal axis, and said bracket further including fasteners passing through said second set of holes and attaching to said substrate to secure said bracket to said substrate, and said substrate being formed by a plurality of purlins and said bracket being rigidly attached to said purlins to prevent rolling of said purlins.

2. A continuous clip for securing roofing panels to a substrate comprising:

(a) a bracket having a longitudinal axis, said bracket extending greater than 11 inches along said axis, and said bracket having a first set of spaced apart holes being generally distributed along the bracket in the direction of said longitudinal axis, (b) clip means formed by a plurality of individual clips for attaching said bracket to said substrate in which each individual clip is formed of a strip of flexible material and each of said individual clip is passed through one of said first set of holes to attach each of said individual clips to said bracket and each of said individual clips is attached to said roofing panels to attach said roofing panels to said bracket by way of said individual clips, and (c) a second set of spaced apart holes, said second set of spaced apart holes being distributed along said bracket in the direction of said longitudinal axis, and said bracket further including fasteners passing through said second set of holes and attaching to said substrate to secure said bracket to said substrate, and said bracket being supported by a plurality of purlins, said bracket is supported by a plurality of purlins and said bracket contains individual clips between purlins to support roof panels between purlins.

* * * * *